US011286962B2

(12) United States Patent
Kim

(10) Patent No.: US 11,286,962 B2
(45) Date of Patent: Mar. 29, 2022

(54) FLOW CONTROL VALVE AND HYDRAULIC MACHINE INCLUDING THE SAME

(71) Applicant: Volvo Construction Equipment AB, Eskilstuna (SE)

(72) Inventor: Jinwook Kim, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 77 days.

(21) Appl. No.: 16/650,263

(22) PCT Filed: Sep. 29, 2017

(86) PCT No.: PCT/KR2017/011033
§ 371 (c)(1),
(2) Date: Mar. 24, 2020

(87) PCT Pub. No.: WO2019/066111
PCT Pub. Date: Apr. 4, 2019

(65) Prior Publication Data

US 2021/0207622 A1 Jul. 8, 2021

(51) Int. Cl.
*F15B 13/04* (2006.01)
*F15B 11/16* (2006.01)
(Continued)

(52) U.S. Cl.
CPC ..... *F15B 13/0402* (2013.01); *F15B 11/167* (2013.01); *F15B 13/026* (2013.01);
(Continued)

(58) Field of Classification Search
None
See application file for complete search history.

(56) References Cited

U.S. PATENT DOCUMENTS 5,890,362 A 4/1999 Wilke
8,100,145 B2 1/2012 Desbois-Renaudin
(Continued)

FOREIGN PATENT DOCUMENTS

JP 2008008386 A 1/2008
JP 2009529636 A 8/2009

OTHER PUBLICATIONS

International Search Report and Written Opinion of the International Searching Authority, PCT/KR2017/011033, dated Jun. 28, 2018, 16 pages.

*Primary Examiner* — Michael Leslie
(74) *Attorney, Agent, or Firm* — Sage Patent Group

(57) ABSTRACT

A flow control valve includes a valve body having an inner circumferential surface defining a longitudinal bore to which first and second fluid passages are connected. A spool is slidably inserted into the bore to allow a flow of fluid from the first to second fluid passage. A valve regulates a flow rate of fluid flowing through the first fluid passage. A first seat surface is defined between an area in which the first fluid passage is connected to the bore and an area in which the second fluid passage is connected to the bore. When the flow of fluid from the first to second fluid passage is initiated, an area of a gap between the first seat surface and the spool on a plane taken in a transverse direction is 5%~50%, preferably 10%~20% of an area of an opening defined by the first seat surface.

13 Claims, 6 Drawing Sheets

(51) Int. Cl.
*F15B 13/02* (2006.01)
*F15B 13/043* (2006.01)
*F15B 13/06* (2006.01)

(52) U.S. Cl.
CPC ..... *F15B 13/027* (2013.01); *F15B 13/0433* (2013.01); *F15B 13/06* (2013.01); *F15B 2211/30555* (2013.01); *F15B 2211/351* (2013.01); *F15B 2211/426* (2013.01); *F15B 2211/428* (2013.01); *F15B 2211/455* (2013.01); *F15B 2211/6316* (2013.01); *F15B 2211/6346* (2013.01); *F15B 2211/781* (2013.01)

(56) References Cited

U.S. PATENT DOCUMENTS

| | | | | |
|---|---|---|---|---|
| 10,969,026 | B2 * | 4/2021 | Matsuura | E02F 9/22 |
| 2013/0153068 | A1 | 6/2013 | West et al. | |
| 2013/0291530 | A1 * | 11/2013 | Bang | F15B 11/17 60/428 |
| 2014/0034133 | A1 | 2/2014 | Beschomer et al. | |

* cited by examiner

[Fig. 1]
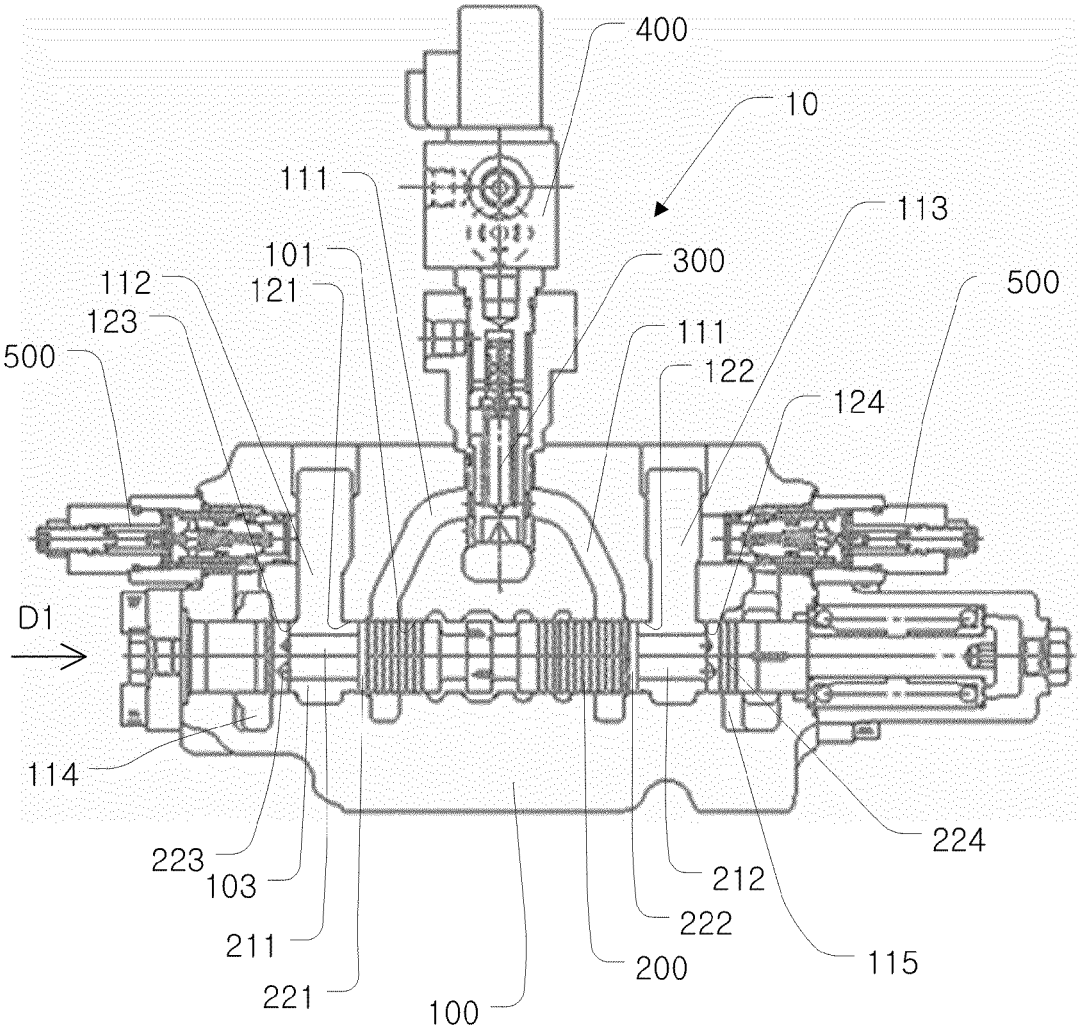

[Fig. 2]
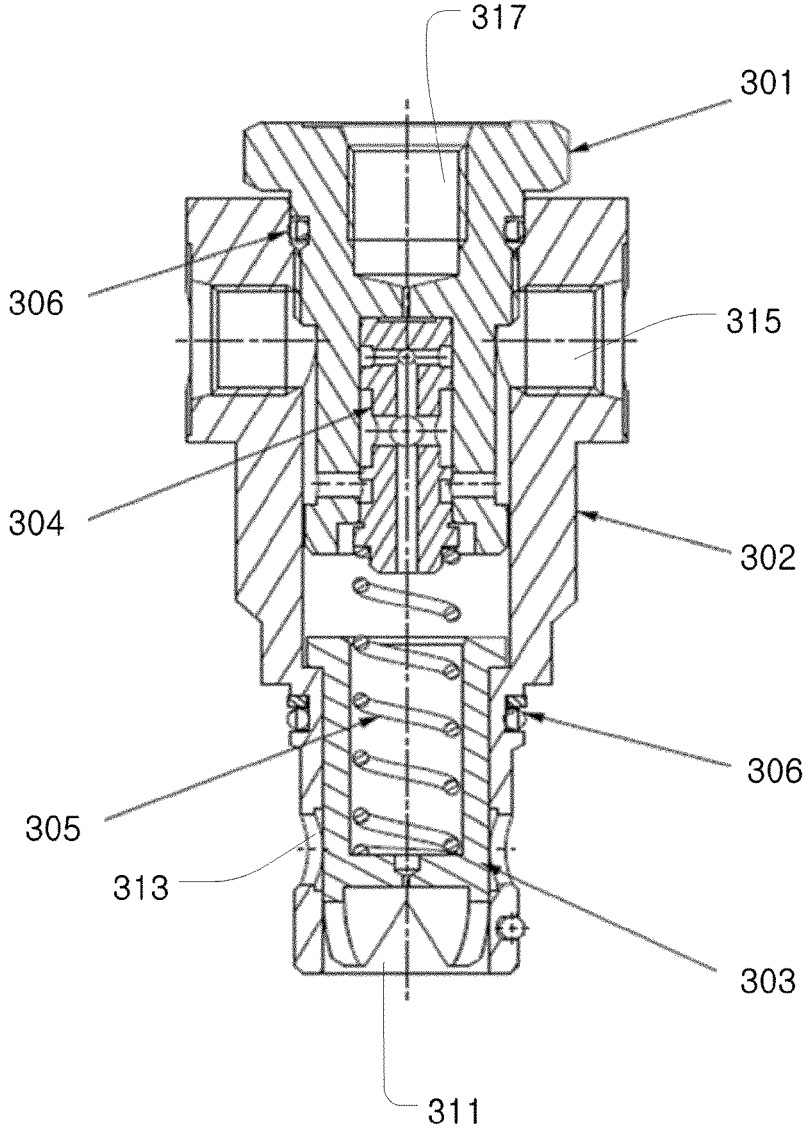
[Fig. 3]
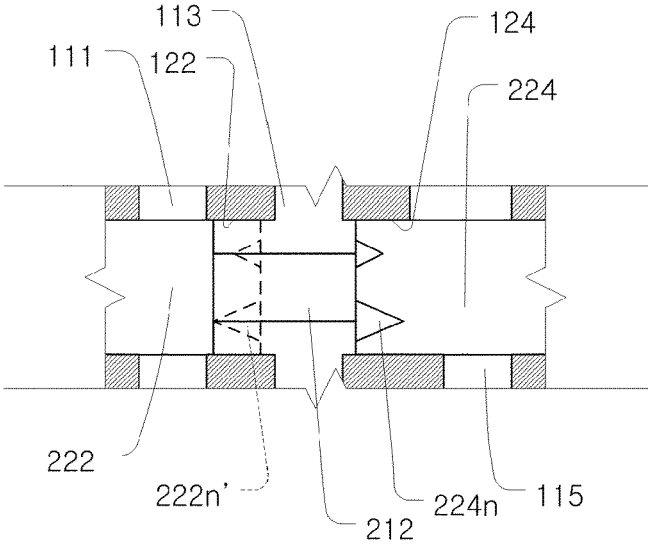

[Fig. 4]
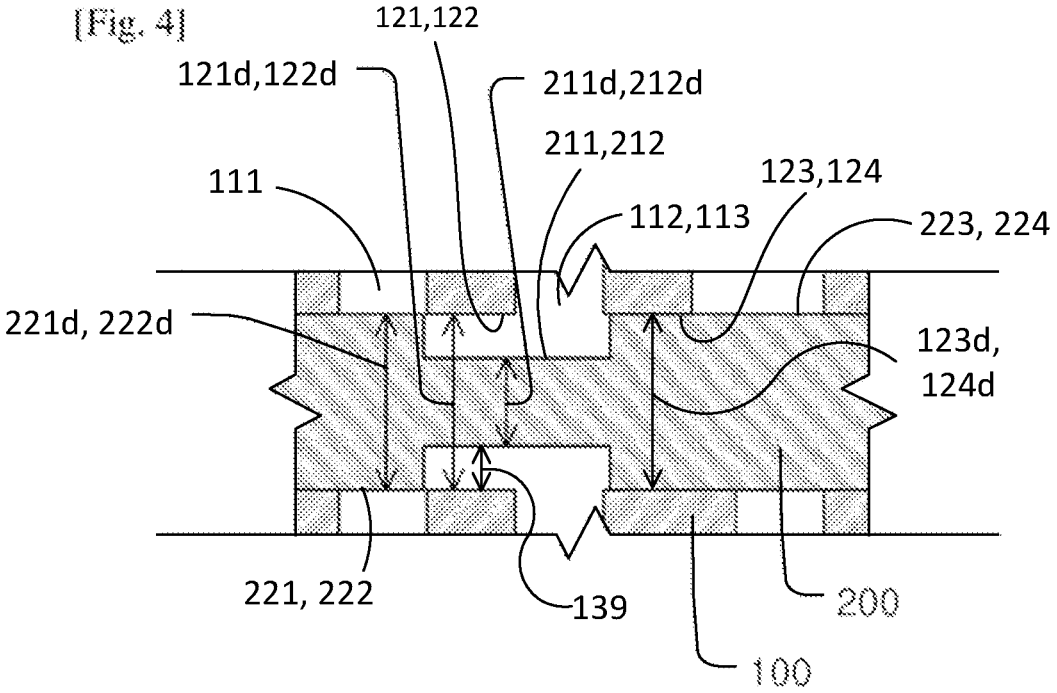
[Fig. 5]
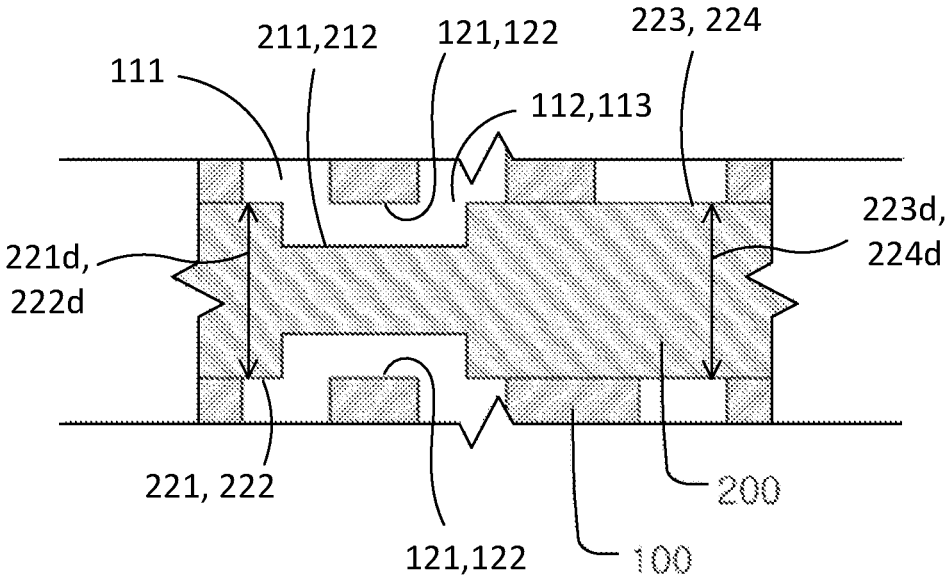

[Fig. 6]
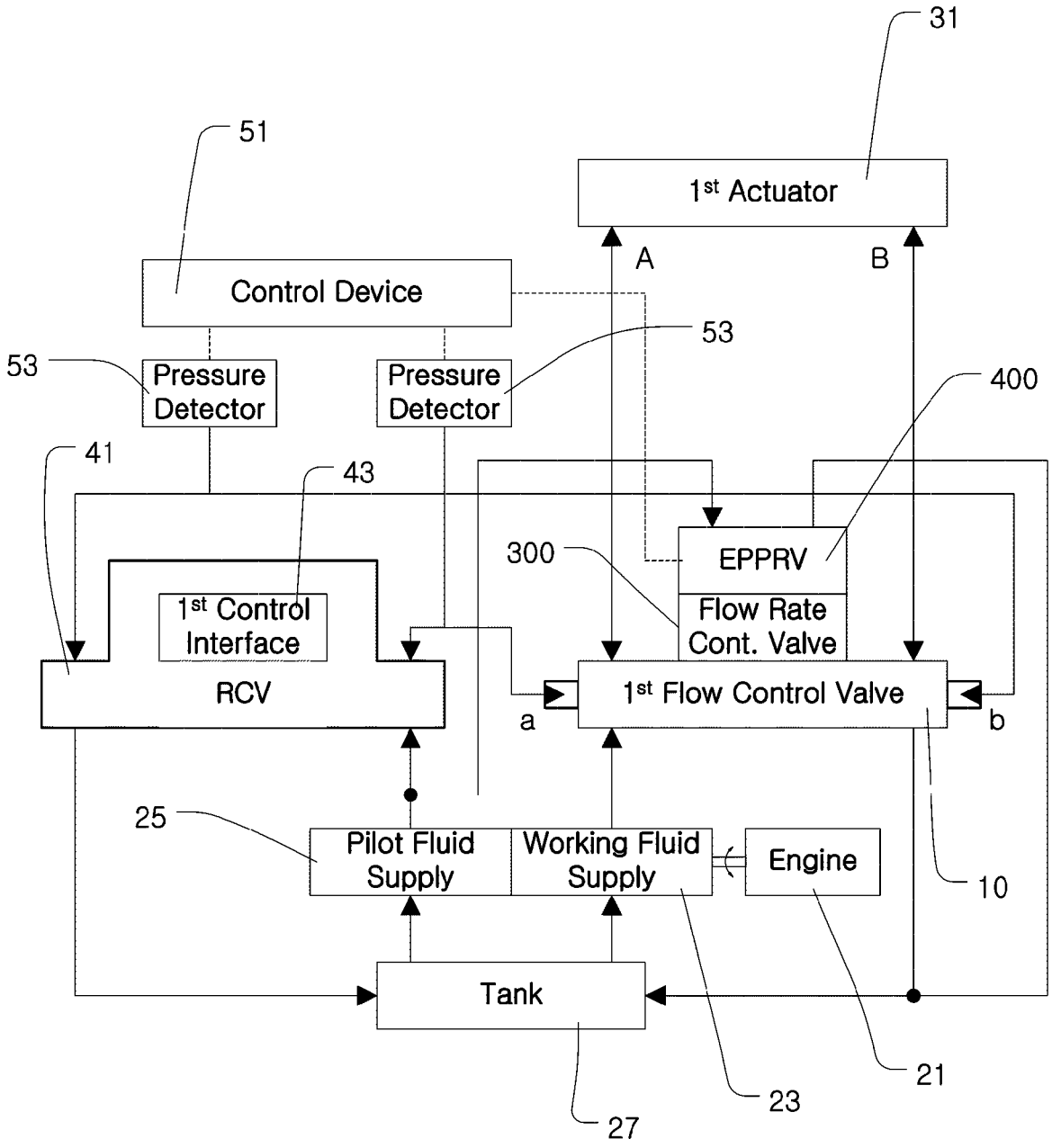

[Fig. 7]
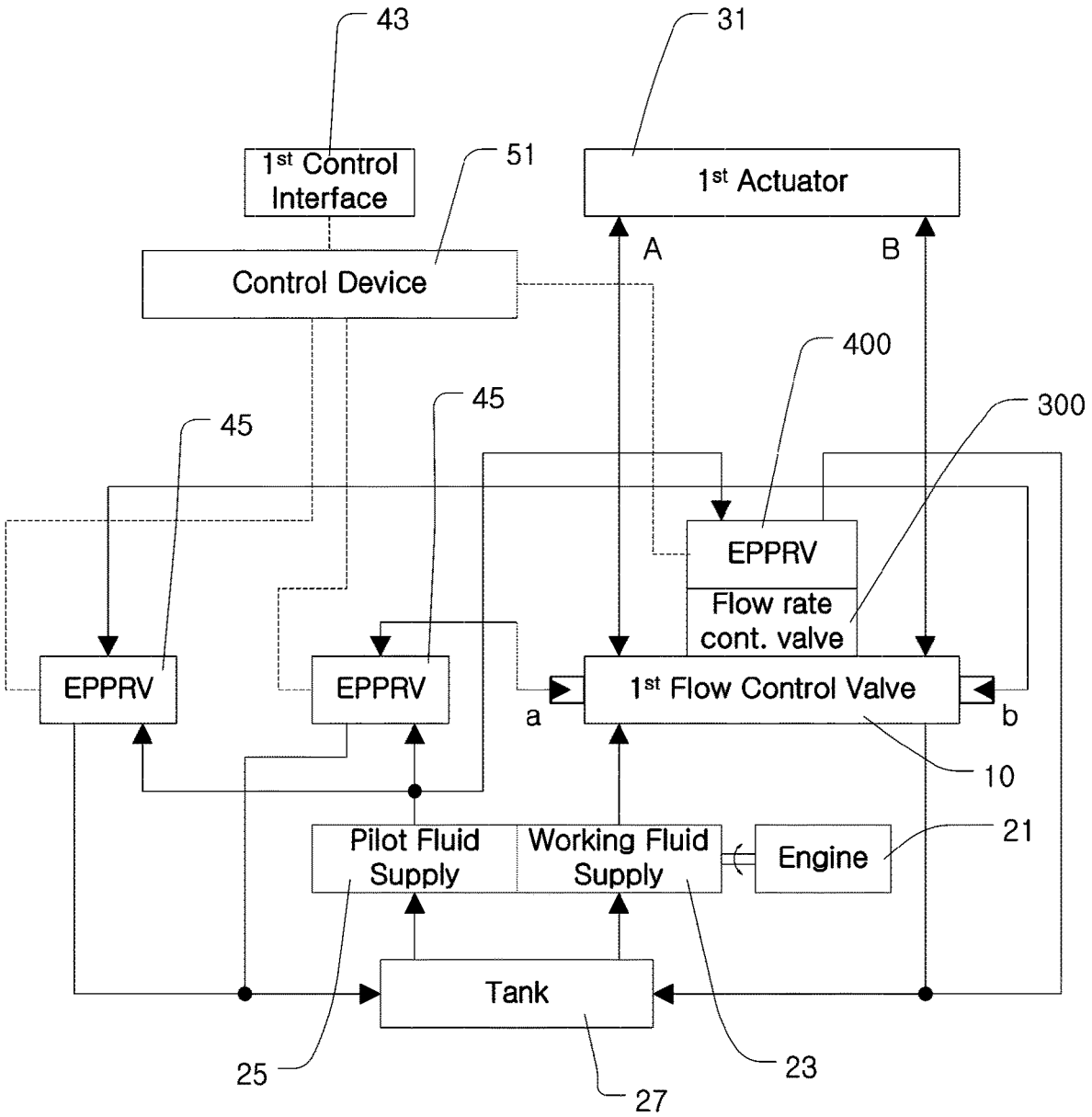

[Fig. 8]
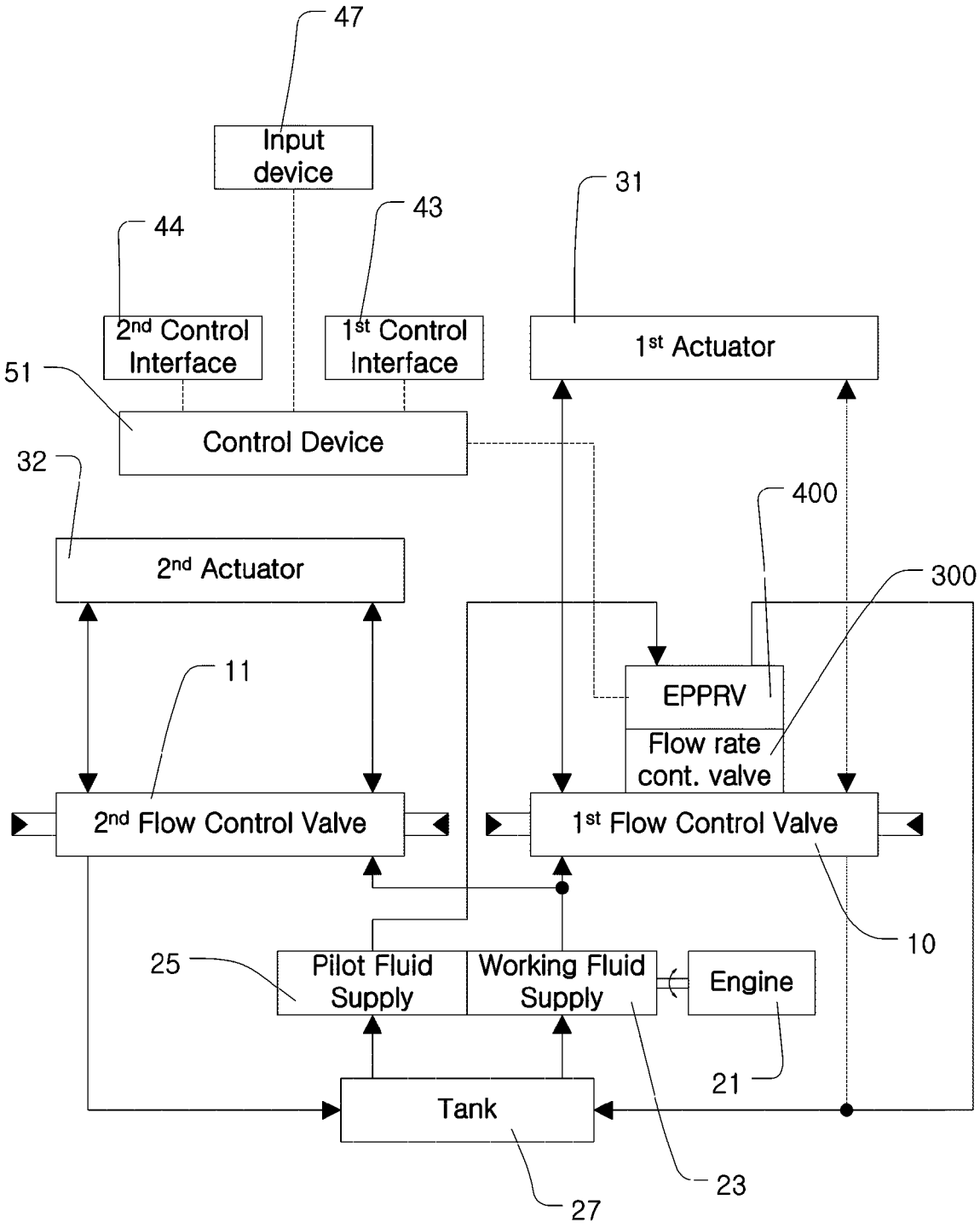

FLOW CONTROL VALVE AND HYDRAULIC MACHINE INCLUDING THE SAME

CROSS REFERENCE TO RELATED APPLICATIONS

This application is a 35 U.S.C. § 371 national stage application of PCT International Application No. PCT/KR2017/011033 filed on Sep. 29, 2017, the disclosure and content of which is incorporated by reference herein in its entirety.

TECHNICAL FIELD

The present disclosure relates to a flow control valve and a hydraulic machine including the same. More particularly, the present disclosure relates to a flow control valve with a novel structure and a hydraulic machine including the same.

BACKGROUND ART

A variety of machines producing power by supplying pressurized fluid are used in construction sites, industrial fields, and the like. In general, such a machine has a flow control valve regulating the flow of pressurized fluid to supply pressurized fluid along different paths, in accordance with respective requests.

A flow control valve generally includes a spool therein, with notches being formed in an outer circumferential surface of the spool. The notches are configured to gradually increase or reduce the area of a fluid path at an initial stage of opening of the fluid path or at a final stage of closing of the fluid path, thereby allowing an actuator to operate smoothly without impacts when starting or ending the operation. However, in the flow control valve having this structure, the notches performing a flow control function are formed in the outer circumferential surface of the spool, as described above. It is therefore impossible to independently regulate, for example, the flow rate of a flow directed to the actuator and the flow rate of a flow returning from the actuator. Thus, improvements in controllability and fuel efficiency are limited.

The flow control valve generally has a check valve integrated therewith. The check valve allows fluid to flow in one direction from a fluid supply to the actuator while preventing fluid from flowing in the reverse direction from the actuator to the fluid supply, when the pressure of the actuator is higher than the pressure of the fluid supply, due to a load applied to the actuator. However, the check valve can only be opened or closed to allow or cut off a flow of fluid, but does not have a flow rate control function.

In such a hydraulic machine, when fluid is supplied to a plurality of actuators by a single fluid supply, an intended amount of fluid is not supplied to an actuator among the plurality of actuators to which a relatively high pressure is applied. The actuator, to which a relatively high pressure is applied, may only be able to start work after the other actuators to which relatively lower pressures are applied have completed work.

To overcome this problem, some flow control values have a priority valve integrated therewith. For example, the priority valve may be disposed on a fluid passage of the flow control valve to restrict a flow of fluid, so that a greater amount of fluid is preferentially supplied to another flow control valve. However, the priority valve is a type of orifice, which may cause a pressure drop and lower fuel efficiency.

Therefore, a flow control value having a novel structure is demanded.

DISCLOSURE OF INVENTION

Technical Problem

Accordingly, the present disclosure has been made in consideration of the above-described problems occurring in the related art, and the present disclosure is intended to provide a flow control valve having an improved flow rate control function to provide an actuator with fluid at an accurate flow rate, as required. Also provided is a novel flow control valve that can overcome problems occurring in flow control valves of the related art in which a flow rate greater than a requested flow rate is concentrated in a specific actuator or a pressure drop is caused by a priority valve used to prevent the concentration of the greater flow rate. Also provided is a flow control valve having a flow rate control valve to substitute for notches regulating the flow rate of fluid directed to an actuator, thereby controlling the flow rate of fluid directed to the actuator independently of the flow rate of fluid returning to the actuator. It is thereby possible to significantly improve machine controllability and fuel efficiency.

Solution to Problem

According to an aspect of the present disclosure, a flow control valve may include: a valve body configured to include an inner circumferential surface defining a bore extending in a longitudinal direction, wherein at least a portion of a first fluid passage and a second fluid passage are formed in the valve body to be connected to the bore; a spool configured to be slidably inserted into the bore, the spool movable to a position in which the spool allows a flow of fluid from the first fluid passage to the second fluid passage; and a flow rate control valve configured to be located on the first fluid passage to regulate a flow rate of fluid flowing through the first fluid passage. The inner circumferential surface may have a first seat surface located between an area in which the first fluid passage is connected to the bore and an area in which the second fluid passage is connected to the bore. At a second point in time at which the flow of fluid from the first fluid passage to the second fluid passage is initiated, an area of a gap between the first seat surface and the spool on a plane taken in a transverse direction, perpendicular to the longitudinal direction, may be 5%~50%, preferably 10%~20% of an area of an opening defined by the first seat surface.

A third fluid passage may be further formed in the valve body to be connected to the bore. The spool may be movable to the position in which the spool allows the flow of fluid from the first fluid passage to the second fluid passage or a position in which the spool allows a flow of fluid from the first fluid passage to the third fluid passage. The inner circumferential surface may further include a second seat surface located between an area in which the first fluid passage is connected to the bore and an area in which the third fluid passage is connected to the bore. At a third point in time at which the flow of fluid from the first fluid passage to the third fluid passage is initiated, an area of a gap between the second seat surface and the spool on a plane taken in the transverse direction may be 5%~50%, preferably 10%~20% of an area of an opening defined by the second seat surface.

According to an aspect of the present disclosure, a hydraulic machine may include: a fluid supply; a first flow control valve configured to be in fluid communication with the fluid supply; a first actuator configured to be in fluid communication with the first flow control valve; and a first control interface configured to generate a signal when manipulated by an operator. The first flow control valve may include: a valve body configured to include an inner circumferential surface defining a bore extending in a longitudinal direction, wherein at least a portion of a first fluid passage, a second fluid passage, and a third fluid passage are formed in the valve body to be connected to the bore; a spool configured to be slidably inserted into the bore, the spool movable to a position in which the spool allows a flow of fluid from the first fluid passage to the second fluid passage or a position in which the spool allows a flow of fluid from the first fluid passage to the third fluid passage; and a flow rate control valve configured to be located on the first fluid passage to regulate a flow rate of fluid flowing through the first fluid passage as a function of the signal generated by the first control interface. The inner circumferential surface may include a first seat surface located between an area in which the first fluid passage is connected to the bore and an area in which the second fluid passage is connected to the bore and a second seat surface located between an area in which the first fluid passage is connected to the bore and an area in which the third fluid passage is connected to the bore. At a second point in time at which the flow of fluid from the first fluid passage to the second fluid passage is initiated, an area of a gap between the first seat surface and the spool on a plane taken in a transverse direction, perpendicular to the longitudinal direction, may be 5%~50%, preferably 10%~20% of an area of an opening defined by the first seat surface. At a third point in time at which the flow of fluid from the first fluid passage to the third fluid passage is initiated, an area of a gap between the second seat surface and the spool on a plane taken in the transverse direction may be 5%~50%, preferably 10%~20% of an area of an opening defined by the second seat surface.

BRIEF DESCRIPTION OF DRAWINGS

FIG. 1 schematically illustrates a flow control valve according to exemplary embodiments;

FIG. 2 is a cross-sectional view illustrating a flow rate control valve of the flow control valve illustrated in FIG. 1;

FIGS. 3 to 5 sequentially illustrate an opening operation of the flow control valve according to exemplary embodiments;

FIG. 6 is a block diagram schematically illustrating the configuration of a hydraulic machine according to exemplary embodiments;

FIG. 7 is a block diagram schematically illustrating the configuration of a hydraulic machine according to exemplary embodiments; and FIG. 8 is a block diagram schematically illustrating the configuration of a hydraulic machine according to exemplary embodiments.

MODE FOR THE INVENTION

Hereinafter, exemplary embodiments of the present disclosure will be described in detail with reference to the accompanying drawings.

FIG. 1 schematically illustrates a flow control valve 10 according to exemplary embodiments.

The flow control valve 10 includes a valve body 100, a spool 200, and a flow rate control valve 300.

The valve body 100 has an inner circumferential surface 101 defining a bore 103 extending in a longitudinal direction D1. A portion of a first fluid passage 111, a second flow passage 112 and a third fluid passage 113 are formed in the valve body 100. The first, second, and third fluid passages 111, 112, and 113 communicate with the bore 103. The first fluid passage 111 may be a fluid passage communicating with a fluid supply. The second fluid passage 112 and the third fluid passage 113 may be fluid passages communicating with actuators. The inner circumferential surface 101 includes a first seat surface 121 and a second seat surface 122. The first seat surface 121 is located between an area in which the first fluid passage 111 is connected to the bore 103 and an area in which the second fluid passage 112 is connected to the bore 103. The second seat surface 122 is located between an area in which the first fluid passage 111 is connected to the bore 103 and an area in which the third fluid passage 113 is connected to the bore 103. As illustrated in FIG. 1, the second fluid passage 112, the first fluid passage 111, and the third fluid passage may be sequentially connected to the bore 103 in the longitudinal direction D1.

A fourth fluid passage 114 and a fifth fluid passage 115 are formed in the valve body 100. The fourth fluid passage 114 and the fifth fluid passage 115 are connected to the bore 103. The fourth fluid passage 114 and the fifth fluid passage 115 may be fluid passages communicating with a tank. The inner circumferential surface 101 includes a third seat surface 123 located between an area in which the second fluid passage 112 is connected to the bore 103 and an area in which the fourth fluid passage 114 is connected to the bore 103. In addition, the inner circumferential surface 101 includes a fourth seat surface 124 located between an area in which the third fluid passage 113 is connected to the bore 103 and an area in which the fifth fluid passage 115 is connected to the bore 103.

The spool 200 is slidably inserted into the bore 103. The spool 200 can be shifted between a first position, a second position, and a third position. The first position is a neutral position. When the spool 200 is in the first position, as illustrated in FIG. 1, the flow control valve 10 cuts off a flow of fluid from the first fluid passage 111 to either the second fluid passage 112 or the third fluid passage 113. When the spool 200 is in the second position, the flow control valve 10 allows a flow of fluid from the first fluid passage 111 to the second fluid passage 112. When the spool 200 is in the third position, the flow control valve 10 allows a flow of fluid from the first fluid passage 111 to the third fluid passage 113.

The spool 200 includes a first valley 211 and a second valley 212. The spool 200 includes a first land 221 and a second land 222. As illustrated in FIG. 1, the first valley 211, the first land 221, the second land 222, and the second valley 212 are sequentially located in the longitudinal direction D1. In addition, the spool 200 includes a third land 223 and a fourth land 224. As illustrated in FIG. 1, the third land 223, the first valley 211, the first land 221, the second land 222, the second valley 212, and the fourth land 224 are sequentially located in the longitudinal direction D1. The third land 223 is configured to be fitted into an opening defined by the third seat surface 123 to cut off a flow of fluid from the second fluid passage 112 to the fourth fluid passage 114. The fourth land 224 is configured to be fitted into an opening defined by the fourth seat surface 124 to cut off a flow of fluid from the third fluid passage 113 to the fifth fluid passage 115. When the spool 200 is in the first position, the third land 223 and the fourth land 224 can be fitted into the openings defined by the third seat surface 123 and the fourth seat surface 124, respectively. When the spool 200 is in the second position, the third land 223 can be fitted into the opening defined by the third seat surface 123. When the spool 200 is in the third position, the fourth land 224 can be fitted into the opening defined by the fourth seat surface 124.

The flow rate control valve 300 is located on the first fluid passage to regulate the flow rate of fluid flowing through the first fluid passage 111. As illustrated in FIG. 1, the entirety of the first fluid passage 111 is formed in the valve body 100. In this configuration, the flow rate control valve 300 may be mechanically and/or structurally connected to the valve body 100. Alternatively, only a portion of the first fluid passage 111 may be formed in the valve body 100, and the remaining portion of the first fluid passage 111 may extend from the valve body 100. In this configuration, the flow rate control valve 300 may be disposed on the remaining portion of the first fluid passage 111. The flow rate control valve 300 may be a pilot-operated valve, operated by pilot pressure.

The flow control valve 10 may include an electro-proportional pressure reducing valve 400. The electro-proportional pressure reducing valve 400 is connected to the flow rate control valve 300 such that the electro-proportional pressure reducing valve 400 can control the flow rate control valve 300 to be opened or closed, as well as the degree of opening, by applying pilot pressure to the flow rate control valve 300. Although the electro-proportional pressure reducing valve 400 is directly connected to the flow rate control valve 300 in FIG. 1, the electro-proportional pressure reducing valve 400 may be disposed at a distance from the flow rate control valve 300 to be indirectly connected to the flow rate control valve 300 by an intervening duct or the like.

Reference numeral 500 indicates a relief valve.

FIG. 2 is a cross-sectional view illustrating the flow rate control valve 300 of the flow control valve 10 illustrated in FIG. 1.

The flow rate control valve 300 may include a plug 301, a sleeve 302, a poppet 303, a spool 304, and a spring 305.

Working fluid drawn from a working fluid supply flows into a backpressure chamber through an orifice in the poppet 303.

When no pilot pressure is applied through a port 317 by the electro-proportional pressure reducing valve 400, a total of an amount of force by which fluid within the backpressure chamber downwardly presses the poppet 303 and an amount of force by which the spring 305 downwardly presses the poppet 303 is greater than an amount of force by which working fluid pushes the poppet 303 from below the poppet 303 upwardly, so that the poppet 303 remains closed.

When pilot pressure is applied through the port 317 by the electro-proportional pressure reducing valve 400, the spool 303 is shifted downwardly against the force of the spring 305. At this time, fluid within the backpressure chamber is drained through the port 315 after sequentially passing through the inner passage of the spool 304 and the inner passage of the plug 301, so that the pressure within the backpressure chamber is lowered. Thus, the poppet 303 is moved upwardly by the force of working fluid pushing the poppet 303 upwardly from below the poppet 303, thereby opening a port 313. Thus, working fluid sequentially flows into the first fluid passage 111 through the port 311 and the port 313. The upward displacement of the poppet 303, i.e. the degree of opening of the port 313, varies depending on the level of pilot pressure applied by the electro-proportional pressure reducing valve 400. In the case of attempting to direct fluid from the working fluid supply to the first fluid passage 111 at a greater flow rate, a control device may be only required to send a greater electric signal to the electro-proportional pressure reducing valve 400.

Reference numeral 306 indicates an O-ring.

FIGS. 3 to 5 sequentially illustrate an opening operation of the flow control valve according to exemplary embodiments.

The outer diameter 211 *d* of the first valley 211 is smaller than the diameter 121 *d* of an opening defined by the first seat surface 121, while the outer diameter 212 *d* of the second valley 212 is smaller than the diameter 122 *d* of an opening defined by the second seat surface 122. The outer diameter 221 *d* of the first land 221 is substantially the same as the diameter 121 *d* of the opening defined by the first seat surface 121, while the outer diameter 222 *d* of the second land 222 is substantially the same as the diameter 122 *d* of the opening defined by the second seat surface 122.

The outer diameter 211 *d* of the first valley 211 is smaller than the diameter 123 *d* of the opening defined by the third seat surface 123, while the outer diameter 212 *d* of the second valley 212 is smaller than the diameter 124 *d* of the opening defined by the fourth seat surface 124. The outer diameter 223 *d* of the third land 223 is substantially the same as the diameter 123 *d* of the opening defined by the third seat surface 123, while the outer diameter 222 *d* of the fourth land 224 is substantially the same as the diameter 124 *d* of the opening defined by the fourth seat surface 124.

At a first point in time at which both the flow of fluid from the first fluid passage 111 to the second fluid passage 112 and the flow of fluid from the first fluid passage 111 to the third fluid passage 113 are cut off, the first land 221 overlaps (i.e. is fitted into) at least a portion of the first seat surface 121, and the second land 222 overlaps (i.e. is fitted into) at least a portion of the second seat surface 122, as illustrated in FIG. 3. Alternatively, at the first point in time, the first valley 211 can overlap the entirety of the first seat surface 121, the second valley 212 can overlap the entirety of the second seat surface 122, and the flow rate control valve 300 can block the first fluid passage 111. For example, to allow fluid to flow from the first fluid passage 111 to the third fluid passage 113, it may be necessary to cut off fluid communications between the first fluid passage 111 and the second fluid passage 112 by displacing the spool 200 prior to opening the flow rate control valve 300. Although the third land 223, the first valley 211, and the first land 221 are configured to be substantially symmetrical to the second land 222, the second valley 212, and the fourth land 227, the third land 223, the first valley 211, and the first land 221 may not be symmetrical to the second land 222, the second valley 212, and the fourth land 227.

At the second point in time at which the flow of fluid from the first fluid passage 111 to the second fluid passage 112 is initiated, the area of a gap 139 between the first seat surface 121 and the spool 200 on a plane taken in a transverse direction, perpendicular to the longitudinal direction D1, may be 5%~50%, preferably 10%~20% of the area of the opening defined by the first seat surface 121 having diameter 121 *d*. As illustrated in FIG. 4, at a third point in time at which the flow of fluid from the first fluid passage 111 to the third fluid passage 113 is initiated, the area of a gap 139 between the second seat surface 122 and the spool 200 (the second valley 212 in FIG. 4) on a plane taken in the transverse direction may be 5%~50%, preferably 10%~20% of the area of the opening defined by the second seat surface 122. Although each of the opening defined by the first seat surface 121, the opening defined by the second seat surface 122, the first valley 211, and the second valley 212 may have the same diameter in the longitudinal direction D1, the present disclosure is not limited thereto. The diameter of the opening defined by the first seat surface 121 and the diameter of the first valley 211 may vary in the longitudinal direction Dl. In this embodiment, the area of each gap varies in the longitudinal direction D1, such that each gap has at least two areas between the first seat surface 121 and the spool 200. The diameter of the opening defined by the second seat surface 122 and the diameter of the second valley 212 may vary in the longitudinal direction Dl. In this embodiment, the area of each gap varies in the longitudinal direction D1, such that each gap has at least two areas between the second seat surface 122 and the spool 200. However, in these embodiments, the area of each gap may be required to be 5%~50%, preferably 10%~20% of the area of the opening corresponding thereto.

The spool 200 satisfying the above-described requirements is configured such that a first notch allowing the first fluid passage and the second fluid passage to communicate with each other and a second notch 222*n*', allowing the first fluid passage and the third fluid passage to communicate with each other, which exist in the related art, are removed.

However, only one of the first notch and the second notch 222' may be removed. In the spool of the related art, the area of the gap between a portion of the spool having these notches and a seat surface is less than 5% of the area of the opening defined by the seat surface. In a flow control valve of the related art, the first notch and the second notch 222*n*' serve to regulate the flow rate of fluid by initializing a flow of fluid therethrough at the second point in time and the third point in time, respectively. In contrast, exemplary embodiments according to the present disclosure increase the area of the gap to be 5%~50%, preferably 10%~20%, making it possible to control the flow rate of fluid directed to the second fluid passage 112 or the third fluid passage 113 by regulating the degree of opening of the flow rate control valve instead of adjusting the area of the gap. It is therefore possible to overcome the problems of the flow control valve of the related art. In addition, a flow of fluid from the first fluid passage 111 to the second fluid passage 112 and a flow of fluid from the first fluid passage 111 to the third fluid passage 113 can be individually controlled. In the related art, points in time at which a flow of fluid is allowed and cut off and a flow rate variation profile are fixed by the geometric structure of the spool. In contrast, according to exemplary embodiments, points in time at which a flow of fluid from the first fluid passage 111 to the second fluid passage 112 is allowed and cut off and a flow rate variation profile can be individually controlled by regulating the opening and closing of the flow control valve. Likewise, points in time at which a flow of fluid from the first fluid passage 111 to the third fluid passage 113 is allowed and cut off and a flow rate variation profile can also be individually controlled. The individual controllability means that the points in time at which a flow of fluid is allowed or cut off are variable as desired, and that such variations are not influenced by the other flows of fluid. (For example, for a flow from the first fluid passage to the second fluid passage 112, the other flows of fluid include i) a flow from the first fluid passage 111 to the third fluid passage 113, ii) a flow from the second fluid passage 112 to the fourth fluid passage 114, and iii) a flow from the third fluid passage 113 to the fifth fluid passage 115.) Reference numeral 224*n* indicates a fourth notch allowing the third fluid passage 113 and the fifth fluid passage 115 to communicate with each other.

The first valley 211 overlaps the entirety of the first seat surface 121 at the second point in time, while the second valley 212 overlaps the entirety of the second seat surface 122 at the third point in time. The second land 222 overlaps (i.e. is fitted into) at least a portion of the second seat surface 122 at the second point in time, while the first land 221 overlaps (i.e. is fitted into) at least a portion of the first seat surface 121 at the third point in time. The second valley 212 overlaps the entirety of the fourth seat surface 124 at the second point in time, while the first valley 211 overlaps the entirety of the third seat surface 123 at the third point in time.

FIG. 6 is a block diagram schematically illustrating the configuration of a hydraulic machine according to exemplary embodiments.

The hydraulic machine may include a working fluid supply 23, a first flow control valve 10, a first actuator 31, and a first control interface 43. The hydraulic machine may further include at least one among an engine 21, a pilot fluid supply 25, a tank 27, a control device 51, and pressure detectors 53.

Each of the working fluid supply 23 and the pilot fluid supply 25 may be a hydraulic pump drawing fluid from the tank 27 and then discharging pressurized fluid.

The first flow control valve 10 may be a flow control valve, as described above with reference to FIGS. 1 to 3. The first flow control valve 10 may include a valve body 100, a spool, and a flow rate control valve. When the working fluid supply 23 is driven by the engine 21, the working fluid supply 23 draws fluid from the tank 27 and supplies the fluid to the first flow control valve 10. When the spool of the first flow control valve 10 is in the first position, i.e. the neutral position, the first flow control valve 10 directs working fluid from the working fluid supply 23 to return to the tank 27 instead of supplying the working fluid to the first actuator 31. When pilot fluid is provided to the portion indicated by 'a' of the first flow control valve 10, the first flow control valve 10 can be shifted to the third position. In contrast, when pilot fluid is provided to the portion indicated by 'b' of the first flow control valve 10, the first flow control valve 10 can be shifted to the second position.

The first actuator 31 can communicate with the flow control valve 10. The first actuator 31 performs work when provided with working fluid. The first actuator 31 returns the working fluid (i.e. working fluid supplied from the flow control valve 10 when the first actuator 31 is a motor actuator or working fluid within an opposite chamber when the first actuator 31 is a cylinder actuator) to the first flow control valve 10 through a portion opposite to a portion through which the working fluid is provided (i.e. the portion indicated by 'B' or the portion indicated by 'A'). The working fluid returns from the first actuator 31 to the tank 27, thereby forming a closed circuit of working fluid.

Likewise, pilot fluid can also form a closed circuit. The pilot fluid supply 25 can draw fluid from the tank 27 and send the fluid to a remote control valve device 41. The remote control valve device 41 provides pilot pressure to the portion indicated by 'a' or the portion indicated by 'b' of the first flow control valve 10, when the first control interface 43 (e.g. a control lever, a control pedal, or a steering wheel) is manipulated by an operator. The first flow control valve 10 is shifted by pilot pressure applied to a portion thereof (the portion indicated by 'a' or the portion indicated by 'b'), and pilot fluid discharged through the opposite portion (the portion indicated by 'b' or the portion indicated by 'a') returns to the tank 27 through the remote control valve device 41, thereby forming a closed circuit of pilot fluid.

Although a single working fluid circuit is illustrated for the sake of brevity in FIGS. 6 to 8, the hydraulic machine may be provided with a plurality of working fluid supplies 23, and a plurality of working fluid circuits may be provided (from the point of view of the plurality of working fluid supplies 23). (In the case in which a hydraulic machine includes a plurality of working fluid supplies and a single tank, it may be regarded from the point of view of the tank that a single working fluid circuit is provided, since all flows of working fluid supplied by the tank return to the tank.) In addition, although the single flow control valve 10 is illustrated as being provided in the working fluid circuit for the sake of brevity in FIGS. 6 to 7, a plurality of flow control valves may be disposed in parallel in each working fluid circuit, thereby forming parallel circuits. The parallel circuits may have fluid passages referred to as parallel passages.

In addition, a plurality of remote control valve devices 41 may be disposed in parallel in the circuit of pilot fluid, thereby forming a parallel circuit. Although a hydraulic machine is generally provided with a single circuit of pilot fluid, the present disclosure is not limited thereto.

The remote control valve device 41 is generally a device having a valve (not shown) integrated with the first control interface 43 (e.g. a control lever, a control pedal, or a steering wheel) to control the first flow control valve 10 at a distance (the flow control valve 10 located within a cab is at a distance from the first flow control valve 10 located outside of the cab). The remote control valve device 41 may include a spool (not shown) moving in response to the first control interface 43 being manipulated. For example, i) when an operator manipulates the first control interface 43 of the remote control valve device in one direction, the remote control valve device 41 allows pilot fluid that has been supplied thereto by the pilot fluid supply 25 to be supplied to the portion indicated by 'a' of the first flow control valve 10, thereby displacing the spool in the first flow control valve 10 to the right (in the drawings). ii) In contrast, when the operator manipulates the first control interface 43 of the remote control valve device 41 in the opposite direction, the remote control valve device 41 allows pilot fluid supplied by the pilot fluid supply 25 to be supplied to the portion indicated by 'b' of the first flow control valve 10, thereby displacing the spool in the first flow control valve 10 to the left (in the drawings). In addition, the spool in the remote control valve device 41 can be displaced by different distances, depending on the movements of the first control interface 43 of the remote control valve device 41, thereby opening the fluid passage of the remote control valve device 41 at different degrees of opening. Consequently, different levels of pilot pressure are applied to the first flow control valve 10.

The pressure detectors 53 detect pilot pressure directed from the remote control valve device 41 to the first flow control valve 10 and send detection signals to the control device 51.

The control device 51 calculates an amount by which the first control interface 43 is manipulated, based on a detection signal, and opens the fluid passage in the electro-proportional pressure reducing valve 400 to a degree of opening, corresponding to the input. Then, the electro-proportional pressure reducing valve 400 applies a pilot pressure, corresponding to the amount by which the first control interface 43 is manipulated, to the flow rate control valve 300. Consequently, the flow rate control valve 300 is opened to a degree of opening corresponding to the input, input through the first control interface 43. The control device 51 may include an electronic control unit (ECU). The ECU may include a central processing unit, a memory, and the like.

While the flow of fluid from the first fluid passage 111 to the second fluid passage 112 is allowed, the flow rate control valve 300 may be closed when a pressure within the second fluid passage 112 is higher than a pressure within the first fluid passage 111. While the flow of fluid from the first fluid passage 111 to the third fluid passage 113 is allowed, the flow rate control valve 300 may be closed when a pressure within the third fluid passage 113 is higher than a pressure within the first fluid passage 111. That is, the flow rate control valve 300 can act as a check valve, as in the related art.

FIG. 7 is a block diagram schematically illustrating the configuration of a hydraulic machine according to exemplary embodiments.

As illustrated in FIG. 7, the first control interface 43 may be an electric control interface. As an alternative or in addition to the pressure detectors 53 detecting the amount by which the first control interface 43 is manipulated, an electrical signal in response to the first control interface 43 being manipulated is directly transmitted to the control device 51. For example, i) when the operator manipulates the first control interface 43 in one direction, an electrical signal generated in response to the first control interface 43 being manipulated is transmitted to the control device 51. The control device 51 applies an electrical signal corresponding to the received electrical signal to one of electro-proportional pressure reducing valves 45 (e.g. a rightward electro-proportional pressure reducing valve 45 in the drawing). The degree of opening of the electro-proportional pressure reducing valve 45 is adjusted by the control device 51, corresponding to the electrical signal applied to the electro-proportional pressure reducing valve 45. The electro-proportional pressure reducing valve 45 allows pilot fluid supplied thereto by the pilot fluid supply 25 to be supplied to the portion indicated by 'a' of the first flow control valve 10, thereby displacing the spool in the first flow control valve 10 to the right (in the drawing). ii) In contrast, when the operator manipulates the first control interface 43 in the opposite direction (e.g. to the left in FIG. 7), the electro-proportional pressure reducing valve 45 allows pilot fluid supplied thereto by the pilot fluid supply 25 to be supplied to the portion indicated by 'b' of the first flow control valve 10, thereby displacing the spool in the first flow control valve 10 to the left (in the drawing). In addition, the degree of opening of the fluid passage within the electro-proportional pressure reducing valve 45 varies depending on the amount by which the first control interface 43 is manipulated, thereby adjusting the level of pilot pressure applied to the first flow control valve 10.

FIG. 8 is a block diagram schematically illustrating the configuration of a hydraulic machine according to exemplary embodiments.

The embodiment illustrated in FIG. 8 further includes a second flow control valve 11 and a second actuator 32, in addition to the configuration of the former embodiment described with reference to FIG. 7. To prevent the drawing from being overly complex, no electro-proportional pressure reducing valves (45 in FIG. 7) are illustrated in FIG. 8. (Likewise, an embodiment further including the second flow control valve 11 and the second actuator 32 in addition to the configuration of the former embodiment described with reference to FIG. 6 is conceivable. However, such an embodiment will not be illustrated in the drawing, since the configuration thereof will be readily apparent to a person skilled in the art.)

The second flow control valve 11 communicates with the working fluid supply 23. Although the first flow control valve 10 and the second flow control valve 11 are illustrated as being supplied with working fluid by the same working fluid supply 23 in FIG. 8, the first flow control valve 10 and the second flow control valve 11 may be supplied with working fluid by different working fluid supplies. Although the second flow control valve 11 may be such a flow control valve as described with reference to FIGS. 1 to 5, the second flow control valve 11 may not include a flow rate control valve.

A second actuator 32 communicates with the second flow control valve 11. The hydraulic machine has a first actuator priority mode. In response to the first manipulator 43 being manipulated, the flow rate control valve 300 of the first flow control valve 10 is opened, such that a degree of opening when the first actuator priority mode is active is greater than a degree of opening when the first actuator priority mode is inactive. In addition, or as an alternative, the hydraulic machine has a second actuator priority mode. In response to the first control interface 43 being manipulated, the flow rate control valve 300 of the first flow control valve 10 is opened such that a degree of opening when the second actuator priority mode is active smaller than a degree of opening when the second actuator priority mode is inactive.

The hydraulic machine includes an input device 47 by which an actuator to be operated with priority is selected. For example, when the second actuator priority mode is selected using the input device 47, the second actuator priority mode is activated to open the flow rate control valve 300 of the first flow control valve 10, such that a greater amount of working fluid is supplied, at a preset ratio or a user input ratio, to the second actuator 32 instead of to the first actuator 31. In addition, or as an alternative, the hydraulic machine may be configured, by way of example, such that the second actuator priority mode is not activated until the second control interface 44 is manipulated.

DESCRIPTION OF REFERENCE NUMERALS OF DRAWINGS

10: Flow control valve 11: Flow control valve
21: Engine 23: Working fluid supply
25: Pilot fluid supply 27: Tank
31: Actuator 32: Actuator
41: Remote control valve device
43: Control interface 44: Control interface
45: Electro proportional pressure reducing valve
47: Input device 51: Control device
53: Pressure detector
100: Valve body 101: Inner surface
103: Bore 111: First fluid passage
112: Second fluid passage 113: Third fluid passage
114: Fourth fluid passage 115: Fifth fluid passage
121: First seat surface 122: Second seat surface
122*d*: Diameter 123: Third seat surface
124: Fourth seat surface 200: Spool
211: First valley 212: Second valley
212*d*: Outer diameter 221: First land
222: Second land 222*d*: Outer diameter
222*n*': Notch 223: Third land
224: Fourth land 224*n*: Notch
300: Flow rate control valve 301: Plug
302: Sleeve 303: Poppet
304: Spool 305: Spring
306: O-ring 311, 313, 315, 317: Port
400: Electro-proportional pressure reducing valve
500: Relief valve D1: Longitudinal direction

The invention claimed is:

1. A flow control valve comprising:

a valve body comprising an inner circumferential surface defining a bore extending in a longitudinal direction, wherein at least a portion of a first fluid passage and a second fluid passage are formed in the valve body to be connected to the bore;

a spool configured to be slidably inserted into the bore, the spool movable to a position in which the spool allows a flow of fluid from the first fluid passage to the second fluid passage; and;

a flow rate control valve located on the first fluid passage to regulate a flow rate of fluid flowing through the first fluid passage as a function of a signal generated by a control interface manipulated by an operator, wherein the inner circumferential surface comprises a first seat surface located between an area in which the first fluid passage is connected to the bore and an area in which the second fluid passage is connected to the bore, and at a second point in time at which the flow of fluid from the first fluid passage to the second fluid passage is initiated, an area of a gap between the first seat surface and the spool on a plane taken in a transverse direction, perpendicular to the longitudinal direction, is 5%~50% of an area of an opening defined by the first seat surface.

2. The flow control valve of claim 1, wherein a third fluid passage is further formed in the valve body to be connected to the bore, the spool is movable to the position in which the spool allows the flow of fluid from the first fluid passage to the second fluid passage or a position in which the spool allows a flow of fluid from the first fluid passage to the third fluid passage, the inner circumferential surface further comprises a second seat surface located between an area in which the first fluid passage is connected to the bore and an area in which the third fluid passage is connected to the bore, and at a third point in time at which the flow of fluid from the first fluid passage to the third fluid passage is initiated, an area of a gap between the second seat surface and the spool on a plane taken in the transverse direction is 5%~50% of an area of an opening defined by the second seat surface.

3. The flow control valve of claim 2, wherein the flow rate control valve comprises a pilot-operated valve operated by pilot pressure.

4. The flow control valve of claim 3, further comprising an electro-proportional pressure reducing valve fluidly connected to the flow rate control valve to control a degree of opening of the flow rate control valve by applying pilot pressure to the flow rate control valve.

5. The flow control valve of claim 2, wherein the first fluid passage is in fluid communication with a fluid supply, and the second fluid passage is in fluid communication with an actuator.

6. The flow control valve of claim 2, wherein the spool comprises a first valley and a second valley, an outer diameter of the first valley being smaller than a diameter of the opening defined by the first seat surface, and an outer diameter of the second valley being smaller than a diameter of the opening defined by the second seat surface, and at the second point in time, the first valley overlaps an entirety of the first seat surface, and at the third point in time, the second valley overlaps an entirety of the second seat surface.

7. The flow control valve of claim 6, wherein the second fluid passage, the at least a portion of a first fluid passage, and the third fluid passage are sequentially formed in the longitudinal direction to be connected to the bore, the spool further comprises a first land and a second land, the first valley, the first land, the second land, and the second valley are sequentially located in the longitudinal direction, an outer diameter of the first land being the same as the diameter of the opening defined by the first seat surface, and an outer diameter of the second land being the same as the diameter of the opening defined by the second seat surface, and at the second point in time, the second land overlaps at least a portion of the second seat surface, and at the third point in time, the first land overlaps at least a portion of the first seat surface.

8. The flow control valve of claim 7, wherein, at a first point in time at which both the flow of fluid from the first fluid passage to the second fluid passage and the flow of fluid from the first fluid passage to the third fluid passage are cut off, the first land overlaps at least a portion of the first seat surface, and the second land overlaps at least a portion of the second seat surface.

9. The flow control valve of claim 6, wherein, at a first point in time at which both the flow of fluid from the first fluid passage to the second fluid passage and the flow of fluid from the first fluid passage to the third fluid passage are cut off, the first valley overlaps the entirety of the first seat surface, the second valley overlaps an entirety of the second seat surface, and the flow rate control valve blocks the first fluid passage.

10. The flow control valve of claim 2, wherein a fourth fluid passage and a fifth fluid passage are further formed in the valve body to be connected to the bore, the inner circumferential surface further comprises a third seat surface located between an area in which the second fluid passage is connected to the bore and an area in which the fourth fluid passage is connected to the bore and a fourth seat surface located between an area in which the third fluid passage is connected to the bore and an area in which the fifth fluid passage is connected to the bore, and at the second point in time, the second valley overlaps an entirety of the fourth seat surface, and at the third point in time, the first valley overlaps an entirety of the third seat surface.

11. A hydraulic machine comprising:

a fluid supply;

a first flow control valve in fluid communication with the fluid supply;

a first actuator in fluid communication with the first flow control valve; and a first control interface for generating a signal when manipulated by an operator, wherein the first flow control valve comprises:

a valve body comprising an inner circumferential surface defining a bore extending in a longitudinal direction, wherein at least a portion of a first fluid passage, a second fluid passage, and a third fluid passage are formed in the valve body to be connected to the bore;

a spool slidably inserted into the bore, the spool movable to a position in which the spool allows a flow of fluid from the first fluid passage to the second fluid passage or a position in which the spool allows a flow of fluid from the first fluid passage to the third fluid passage; and a flow rate control valve located on the first fluid passage to regulate a flow rate of fluid flowing through the first fluid passage as a function of the signal generated by the first control interface, wherein the inner circumferential surface comprises a first seat surface located between an area in which the first fluid passage is connected to the bore and an area in which the second fluid passage is connected to the bore and a second seat surface located between an area in which the first fluid passage is connected to the bore and an area in which the third fluid passage is connected to the bore, and at a second point in time at which the flow of fluid from the first fluid passage to the second fluid passage is initiated, an area of a gap between the first seat surface and the spool on a plane taken in a transverse direction, perpendicular to the longitudinal direction, is 5%~50% of an area of an opening defined by the first seat surface, and at a third point in time at which the flow of fluid from the first fluid passage to the third fluid passage is initiated, an area of a gap between the second seat surface and the spool on a plane taken in the transverse direction is 5%~50% of an area of an opening defined by the second seat surface.

12. The hydraulic machine of claim 11, wherein, while the spool is in the position in which the spool allows the flow of fluid from the first fluid passage to the second fluid passage, the flow rate control valve is closed when a pressure within the second fluid passage is higher than a pressure within the first fluid passage, and while the spool is in the position in which the spool allows the flow of fluid from the first fluid passage to the third fluid passage, the flow rate control valve is closed when a pressure within the third fluid passage is higher than a pressure within the first fluid passage.

13. The hydraulic machine of claim 11, further comprising:

a second flow control valve in communication with the fluid supply; and a second actuator in communication with the second flow control valve, the hydraulic machine having a second actuator priority mode, wherein the flow rate control valve regulates the flow rate of fluid flowing through the first fluid passage in response to the signal, such that the flow rate of fluid when the second actuator priority mode is active is smaller than the flow rate of fluid when the second actuator priority mode is inactive.

* * * * *